US011345447B2

(12) United States Patent
Bell

(10) Patent No.: US 11,345,447 B2
(45) Date of Patent: May 31, 2022

(54) ACCESSORY FIN SYSTEM FOR WATERSPORTS INVOLVING BOARDS

(71) Applicant: R. Brandon Bell, West Palm Beach, FL (US)

(72) Inventor: R. Brandon Bell, West Palm Beach, FL (US)

( * ) Notice: Subject to any disclaimer, the term of this patent is extended or adjusted under 35 U.S.C. 154(b) by 0 days.

(21) Appl. No.: 16/907,209

(22) Filed: Jun. 20, 2020

(65) Prior Publication Data

US 2020/0317304 A1 Oct. 8, 2020

Related U.S. Application Data

(63) Continuation-in-part of application No. 16/826,404, filed on Mar. 23, 2020, which is a continuation of application No. 15/950,238, filed on Apr. 11, 2018, now Pat. No. 10,597,123, which is a continuation of application No. 15/419,035, filed on Jan. 30, 2017, now Pat. No. 9,969,469.

(51) Int. Cl.

| | |
|---|---|
| ***B63B 32/60*** | (2020.01) |
| ***B63B 45/00*** | (2006.01) |
| ***H05B 45/10*** | (2020.01) |
| ***H05B 45/20*** | (2020.01) |
| ***H05B 47/19*** | (2020.01) |
| ***H05B 45/00*** | (2022.01) |
| ***F21S 9/02*** | (2006.01) |
| ***F21V 23/06*** | (2006.01) |
| ***F21V 31/00*** | (2006.01) |
| ***F21S 4/28*** | (2016.01) |
| *F21W 102/00* | (2018.01) |
| *F21W 107/20* | (2018.01) |
| *F21Y 103/10* | (2016.01) |
| *F21Y 115/10* | (2016.01) |

(52) U.S. Cl.

CPC ..... *B63B 32/60* (2020.02); *B63B 45/00* (2013.01); *F21S 4/28* (2016.01); *F21S 9/02* (2013.01); *F21V 23/06* (2013.01); *F21V 31/005* (2013.01); *H05B 45/00* (2020.01); *H05B 45/10* (2020.01); *H05B 45/20* (2020.01); *H05B 47/19* (2020.01); *F21W 2102/00* (2018.01); *F21W 2107/20* (2018.01); *F21Y 2103/10* (2016.08); *F21Y 2115/10* (2016.08)

(58) Field of Classification Search

CPC .. B63B 32/60; B63B 45/00; F21S 4/28; F21S 9/02; H05B 45/00; H05B 45/10; H05B 45/20; H05B 47/00; H05B 47/19; F21V 23/00; F21V 23/06; F21V 31/00; F21V 31/005; F21Y 2103/10; F21Y 2115/10; F21W 2107/20; F21W 2102/00

USPC ..... 441/74, 79, 80

See application file for complete search history.

(56) References Cited

U.S. PATENT DOCUMENTS 5,464,359 A * 11/1995 Whitty ..... B63B 32/60 441/79

7,238,075 B2 7/2007 Brodsky (Continued)

*Primary Examiner* — Lars A Olson

(74) *Attorney, Agent, or Firm* — Lambert Shortell & Connaughton; David J. Connaughton, Jr.; Justin P. Tinger

(57) ABSTRACT

A fin for a water sports board capable of receiving one or more insert accessories is provided. The insert accessories may operate to add a functionality to the fin, and to any board the fin is attached to. Typically, the fin disclosed may be used with a surfboard, paddleboard, or similar water sports board.

23 Claims, 9 Drawing Sheets

(56) References Cited

U.S. PATENT DOCUMENTS

| | | | | |
|---|---|---|---|---|
| 9,969,469 | B1 * | 5/2018 | Bell | B63B 32/60 |
| 10,266,239 | B2 * | 4/2019 | Fry | B63B 32/60 |
| 10,597,123 | B2 * | 3/2020 | Bell | F21S 4/28 |
| 2009/0042467 | A1 * | 2/2009 | Huang | B63J 2/00 441/74 |
| 2016/0224227 | A1 * | 8/2016 | Brush | B60K 35/00 |

* cited by examiner

ACCESSORY FIN SYSTEM FOR WATERSPORTS INVOLVING BOARDS

BACKGROUND OF THE INVENTION

Field of the Invention

This invention pertains to a skeg with a hollow cavity (also referred to as an aperture) enabling various devices to be installed and used in any of the various water sports involving watersports boards, surfboards, paddle boards and hydro foils. More particularly a skeg, also referred to as a fin, which is easily transportable and interchangeable between boards and has a hollow geometry which is used to hold accessory inserts: lights, motorized propellers, cameras, micro controllers for augmented reality, power sources or other devices which benefit the user and the exploratory experience. The hollow geometry may allow the user to leave the skeg installed on the board while providing a universal mount system for various inserts (accessories) which can be connected and removed quickly and easily.

Description of Prior Art

The fin of a surfboard has existed since some of the early surfboards, as it was a necessity to maintain a specific direction while traveling over water. While the shape of the fin has evolved and diversified in modern times due to increased demand for specific performance characteristics, that is practically all that has changed from the initial beginnings as a simple piece of wood. Fins are interchangeable and made of a variety of materials, but there is no additional purpose or variation other than the previously stated performance characteristics. The interchangeability of the fin is easy for the user to do.

In recent years, the sport of paddle boarding and surfing have grown in popularity. Especially so in the sport of paddle boarding which exists across a large group of people due to its ease of use on any body of water rather than requiring an ocean swell and all other associated difficulties and dangers that exist in surfing.

Previously, prior art has shown a design which incorporates electronic powered lights into the various boards themselves. This method is expensive and requires the user to purchase an additional board or pay additional installation fees on top of the equipment cost. It is not easily transportable because the boards are approximately 10 feet long. When transportation is required, it is costly especially via common airline. The illumination under the board enables the user to view the immediate surroundings. This method may include lights on the bottom, but again requires a very specific and costly type of board.

Common methods for installing various accessories to a surfboard include suction cups and adhesive. More specialized methods may include incorporating the device into the board which is sometimes more expensive than the board itself and difficult. While these methods prove to be effective, drawbacks may sacrifice performance or be a hassle to use. Adhesive has many drawbacks as it is typically undesirable to attach on expensive, high performance boards. In either case it is common for the attachment to be an addition to the board which in some cases involves wires or LED strips which sacrifice performance due to drag and maneuverability. Other instances involving a camera and suction cup on the bottom of the board may create additional drag as the camera is not factored into the original design of the board with its fins in respect to optimal fluid dynamics. The devices in other instances may interfere with the user itself.

The use of various accessories in surfing, paddle boarding and other water sports has shown the need for a design to allow the user to quickly and easily change from one to the next.

SUMMARY OF THE INVENTION

The subject matter of this application may involve, in some cases, interrelated products, alternative solutions to a particular problem, and/or a plurality of different uses of a single system or article.

It is an object of the present invention to provide a seamless way to incorporate various devices onto the fin of a watersports board. It is another object of the system to create an easily transferable and transportable fin system to universally accept the various devices in minimal time with utmost simplicity.

The present invention utilizes an already existing and familiar structure, the fin. The addition of lights or other accessories to the fin of the board creates a system of easy integration as there is seemingly nothing added to the board which already has fins. The combination is unique and there is no previous evidence of its design in prior art. In some embodiments, the fin comprises of a compartment to hold the power source which may be a battery. For example, there may be a detachable cover to allow removal of the battery which is encased in a waterproof chamber. The compartment may be sealed with a gasket and cover which may be screw type or clamp type. The battery source may be of disposable type or rechargeable type including but not limited to lithium ion, common store bought brand and similar. It should be understood however that the power source may be any source capable of providing power to the light source. This power source may be within the fin, on the water sports board, or external.

In one embodiment, the perimeter of the fin is comprised of a row of lights pointing in an outward direction. In one aspect of the present invention, there may be a waterproof strip of LED's used for illumination. The LED's may be powered by a battery. The lights may have a switch to easily turn on and off. The switch may be on the fin, the board to which the fin is attached, or may be on a separate remote controller. The light strip may be connected to the fin body in any manner. In a particular embodiment, the strip may be fitted to the fin body by a tongue and groove mating arrangement.

In yet another aspect of the present invention, the LED's may be encased in a sheath or other container thus making them waterproof. The LED's may be powered by a battery with or without a switch to control power. The sheath may allow interchangeability of lights allowing a plurality of colors and intensities/brightness to be used. In similar aspects, a lens may be positioned over one or more of the lights on the fin to magnify, focus, scatter, or otherwise adjust the light depending on desired features.

In another aspect of the invention the illumination source may be some form of fiber optic cable in addition to, or instead of LED lights to create yet another form of illumination.

In yet another aspect of the invention, the fin may be equipped with micro controller to allow various combination of color and pulsation of intensity, for a light embodiment. This controller may, in other embodiments, provide other control and features of the system. For example, in one embodiment, a low battery alarm may be initiated by the controller upon determination that the battery power source is running low. The lights and associated color and pulsation may be used for emergency signaling, identification purposes and also to conserve battery.

In another aspect of the invention, there may be an attachment for the lights and battery pack that allows it to be easily removed on a fin. The attachment may consist of hook and loop style adhesive, clamping, press fit or traditional bolt and nut hardware method.

In yet another aspect of the invention, the fin may be constructed of transparent materials allowing an encased illumination source to create a glowing fin.

In another aspect, the fin may be constructed out of two halves for ease of assembly and cleaning. The two halves may attach by various hardware, snap in place or screw type clamp.

In yet another aspect of the invention, various woven composites may be used to construct the main fin body with a resin matrix system.

In yet another aspect the fin may use an adapter to integrate into an existing fin system. A method for attachment may include strap, elastic rope, Velcro or other common method.

In another aspect of the invention, there may be a microcontroller used to control light intensity, color and to control a change in color pattern. The microcontroller may or may not be operated via remote control.

In yet another aspect of the invention, a removable waterproof insert may be used. The insert may removably fit to an open center portion of the fin and house the necessary electronics to provide illumination. Additionally, the center insert may be clear to provide additional light emission from the center. The insert may be removable while leaving the rest of the fin in place for ease of replenishing the power supply.

In some aspects, the fin comprises of a cavity or chamber or other open portion to accept various insert accessory devices. For example, there may be a cylindrical bore in the center of the fin which will hold a tight fitting insert accessory. In one embodiment, the insert accessory may have a cylindrical shaped device such as a motorized propulsion system, underwater lighting system, camera, safety device and/or even microchips for augmented reality purposes. The input accessory device being installed is already water proof and may serve several purposes for the user. The cylindrical bore on the fin may have convex or concave portions to further benefit the retention of said device. The bore may have an additional pin or seat which the device installs into and twists slightly to provide a secure fit among other connection options.

It should be understood however that the cylindrical bore may be any shape capable of holding a device. This shape may be cylindrical, or other, in the direction of travel (lengthwise) or may be a cavity within the perimeter of the fin perpendicular to direction of travel (widthwise), among other options.

The fin may be comprised of similar mass to existing designs such that if no device is installed, the frontal cross sectional area remains low in addition to the overall weight. The fin viewed from the side may appear as a typical fin however from the front or rear there may be a cylindrical bore or similar. In one aspect of the present invention the bore may be circular, elliptical, or other full or partial polygon or shape. The fin may be comprised of a slightly flexible material urethane such that when the device is installed, said device may have a slight convex radius providing necessary force to retain itself in the fin. The device may be installed and uninstalled with one hand in seconds. In a particular embodiment, the device may install into the fin body with a locating key which at the end turns and locks, further securing the device.

In yet another aspect of the present invention, the fin may be shaped such that a primarily flat device can be inserted. The flat shape of the insert would complete the shape of the fin such that there is much less cross sectional area as mentioned in above circular embodiment.

In another aspect of the invention the device may be inserted by way of snap or clicking into place. An interference fit of specific geometry would allow various components to be installed and uninstalled quickly in a matter of seconds with no tools necessary.

In yet another aspect of the invention the accessory may be inserted into the fin bore as a slip fit and then turned onto threads to secure itself in place.

In another aspect of the invention the fin may have a flexible skin over its rigid core in which case the flexible skin has an envelope style opening to accept various accessories.

In yet another aspect of the invention the device may be inserted into the fin cavity from the side, with the device profile being smaller yet similar to the outer perimeter of the fin. The fitment in the cavity may be comprised of a snap or click in interference style fit for retention.

In another aspect of the invention the fin may be inserted into the side of the fin with locating pins oriented such once seated, the device then rotates about the pin axis and then falls inline with the fin.

In yet another aspect of the invention the accessory device may slide into a hollow profile such that once inserted the device will seat and then a twist motion will retain the device by way of a cam commonly known as a twist-lock combination in various other fields and professions.

It should be understood that the fin and related elements may be of varying size and shape without straying from the scope of the present invention.

BRIEF DESCRIPTION OF THE DRAWINGS

Embodiments of the present invention will now be described by way of example only, with reference to the attached figures wherein.

DETAILED DESCRIPTION

Figure 1:
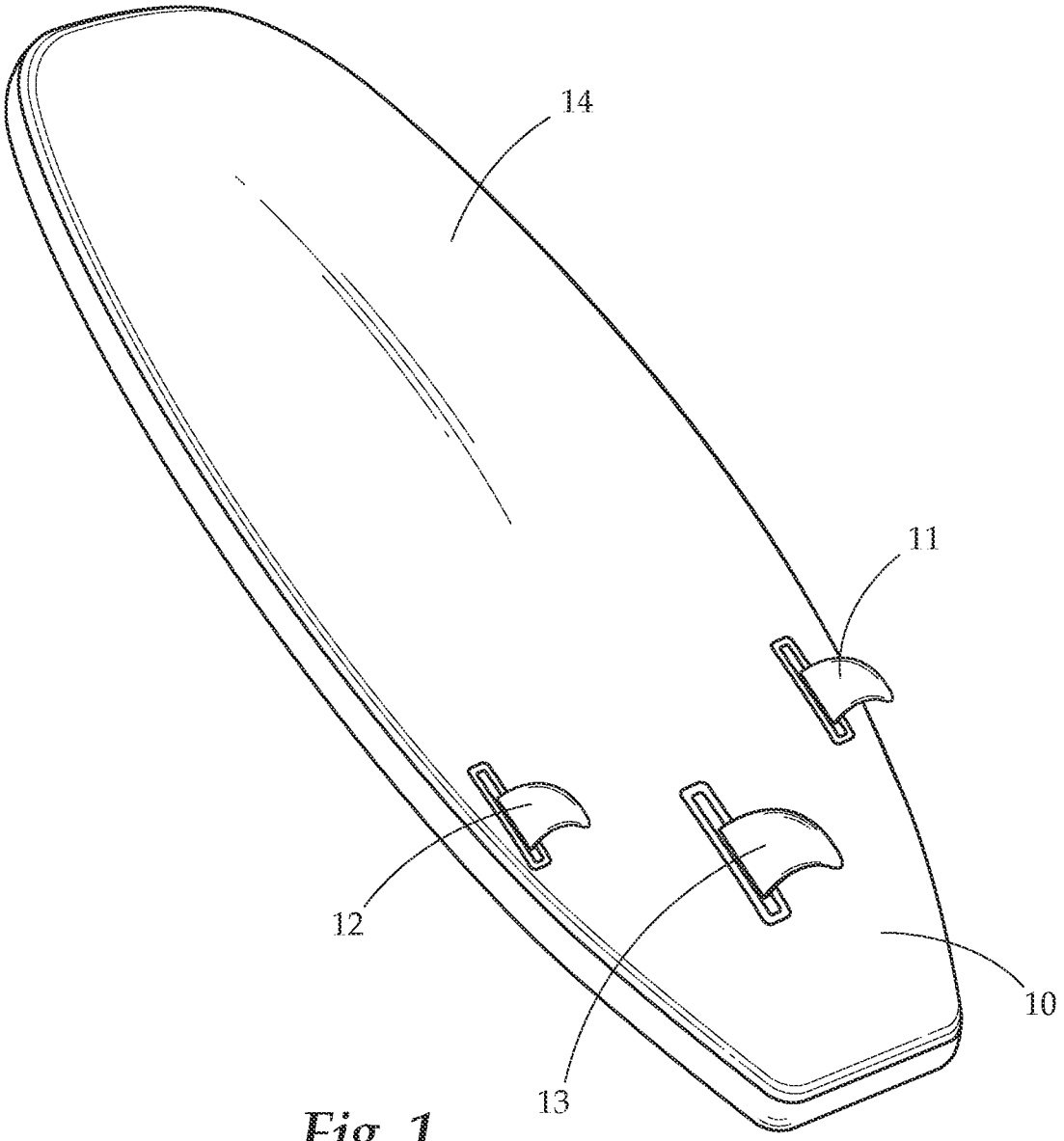
FIG. 1: Provides a perspective view of the present invention illuminating fin installed on a water sports board.

The sport of paddle boarding and other water sports involving boards as contemplated in the present invention involves the use of a board having a fin or set of fins. The fin(s) attach to the bottom of the water sports board and are held in place typically with a setscrew to draw and hold in the attachment point. As the water sports board is propelled through the water the fins help maintain a direction controlled by the paddler and provide stability.

The fins typically are made of a hard, durable plastic, or in other common instances, a composite with resin. The fins may vary in size, shape and color for various performance and aesthetic reasons. Common arrangement of the fin or fins includes a larger center fin which may or may not have two additional fins. The two additional fins sit in parallel sitting slightly closer towards the front and near the outer edges. The tri fin setup resembles a triangular setup in nature. There is some performance to be gained with the tri fin setup, however for most calm water conditions a single fin offers plenty of control for most users. This is the traditional practice utilized and largely inherited from the sport of surfing since inception.

Today current innovation has allowed for fins to be produced by various methods. Additionally, current innovation has allowed for various improvements in electronics. The resulting combination of advanced manufacturing methods and improvements in electronics has allowed for the present invention to improve sports involving water sports boards and associated user experience.

The invention described herein can allow the user to paddleboard at night while maintaining optimal fluid dynamic properties of the paddleboard and improving visibility to one self and others on the open water. The invention described is easily transportable from one destination to another and is easily installed on various watersports boards. In many embodiments, the fin may be removably attachable to the paddle board. For example, the light up fin of the present invention may attach to a water sports board using existing connection systems which allow for removable attachment of paddle board fins. An advantage to this removable attachment is the ability for a user to easily transfer the fin from one board to another. This can allow, for example, simple conversion of a rented board to a lighted board without the need to bring a particular board on a trip. The removable attachability allows enhanced portability for travel, convenience and the like.

Accessories would be easier to use, quicker to install and transport. Accessories would be easier to re-charge, upload data, clean or service. Increase in popularity combined with other advances in modern electronics has left a void in various sports such as the above mentioned. Research shows that there currently is not a quick change utility style fin design. The increased popularity of electronics aiding and augmenting the exploratory experience, safety on the water and personal photography has created a need for a fin system which can hold a variety of components that can be changed in seconds at the users discretion, even easily during use in the water.

In one example, testing in the intracoastal waterways of Miami, Fla. proved that the fins can illuminate the water surrounding at least a portion of the paddle board by up to approximately 20 feet. Water visibility was slightly murky yet the illuminating fins allowed the paddleboard to be easily spotted from shore several hundred feet away. In yet another example of testing in Hawaii, early designs of the fin allowed the user to view the corals just a few feet underwater and attracted several small fish within minutes, providing an exciting exploratory experience for the user.

The invention described herein can allow the user to accessorize their watersports board in a broader, easier and more affordable fashion then ever before while maintaining, or even enhancing, performance characteristics of the board. The invention described is easily transportable, packaged and installed from one destination to another, from one board to the next. The user is no longer limited to specially ordered boards, but rather can accessorize any board easily with the present invention. Furthermore this will create new opportunity for additional innovation within the surfing and paddle boarding community. The second hand markets will benefit as well because the universal system will be easier to sell, ship and install. In many embodiments accessories need not be limited by their function, simply the appropriate shape thus the actual function of each accessory will expand the boundaries that currently exist. Replacement and upkeep of each accessory may become easier and more affordable compared to their respective counterparts. The advantage to the universal insert system will make it easier for the rental community to serve customers with a variety of options; whether it is a lighted board for moon lit tours and/or a motorized accessory to aide in more difficult conditions or currents. The removable attachability allows enhanced portability for travel, convenience and the like.

In one example, testing in West Palm Beach, Fla. with a group of 12 random users proved that the universal accessory fin reduced installation time by an average of 9 minutes each totaling 108 minutes saved. This is exceptional because a small business entity preparing a fleet of boards for 12 users, a single person performing the installation can save well over an hour of time compared to currently available systems. Furthermore, the business entity now has the option to install more than just one accessory in a similar fashion. In yet another example of testing, resistance on the watersports board, when outfitted with one embodiment of the lighting insert in the fin, was measured to be approximately 14% less than current lighting kits commonly available today which require attaching to the boards themselves. The savings in resistance will allow the user to paddle more efficiently resulting in less fatigue over a period of time.

FIG. 1 shows a paddle board 14 fin system generally located at rear bottom surface 10. The fin system is comprised of a main center fin 13 and two optional fins 11 and 12 attached to paddle board 14. The illuminating fin may be center fin 13 and/or fins 11 and 12.

Figure 2:
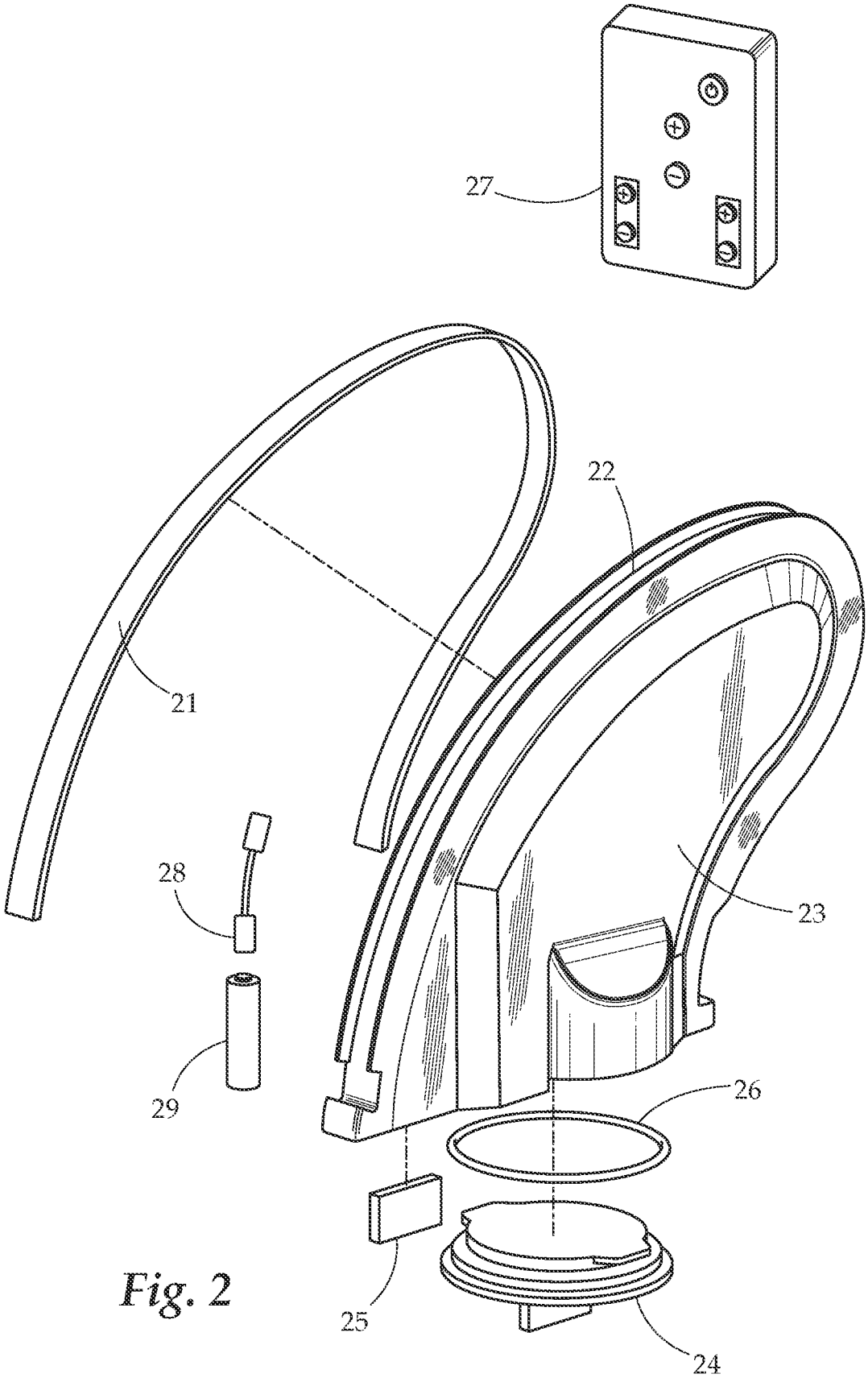
FIG. 2: Provides a partially exploded perspective view of an embodiment of the present invention.

FIG. 2 shows the illuminating fin assembly with 23 representing the fin body. LED light strip 21 is installed into groove 22 on the perimeter of the fin 23. LED light strip 21 may contain any number of LEDs and also capable of various color and being powered by various voltages. In other embodiments, alternative light arrangements may be used without straying from the scope of this invention. Twist lock cover 24 attaches to fin body 23 and compresses o-ring 26 in the assembly to provide a waterproof seal. Twist lock cover 24 utilizes an integrated board attachment point that also is used as leverage for the user to open and close the twist lock cover 24. It should be understood however, that different arrangements for providing access to the interior of the fin body 23 without straying from the scope of the present invention. Second board attachment point 25 is inserted permanently to fin body 23 if it is not already an extension of fin body 23. Remote control 27 is used as an on/off switch in addition to controlling color, brightness and variation of color such as color change, strobe effect, a pulsing of the lights, and the like. Remote control 27 is interfaced with wireless receiver 28 which is connected to battery 29 and LED strip 21.

Figure 3:
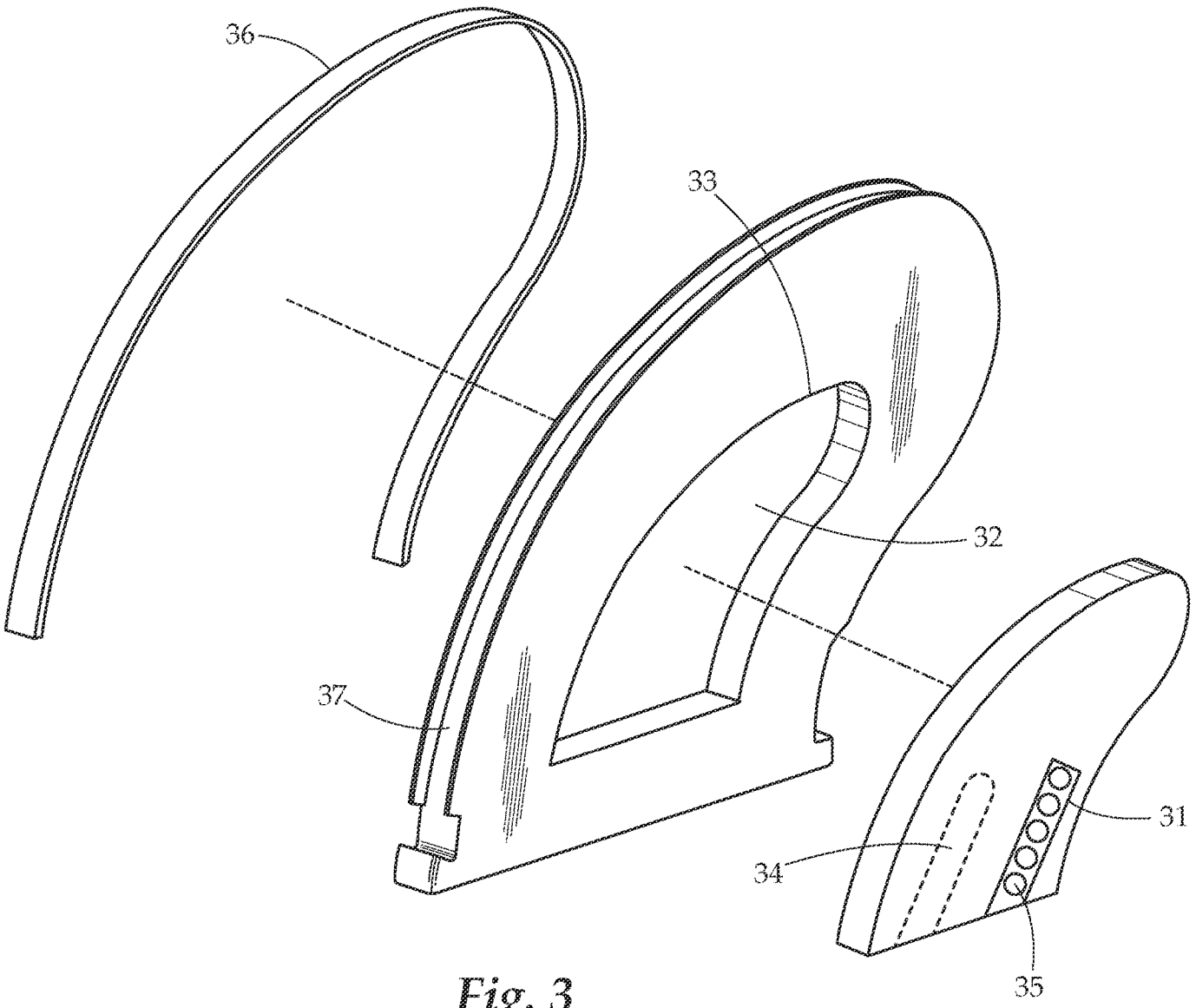
FIG. 3: Provides a partially exploded perspective view of another embodiment of the present invention.
Figure 4:
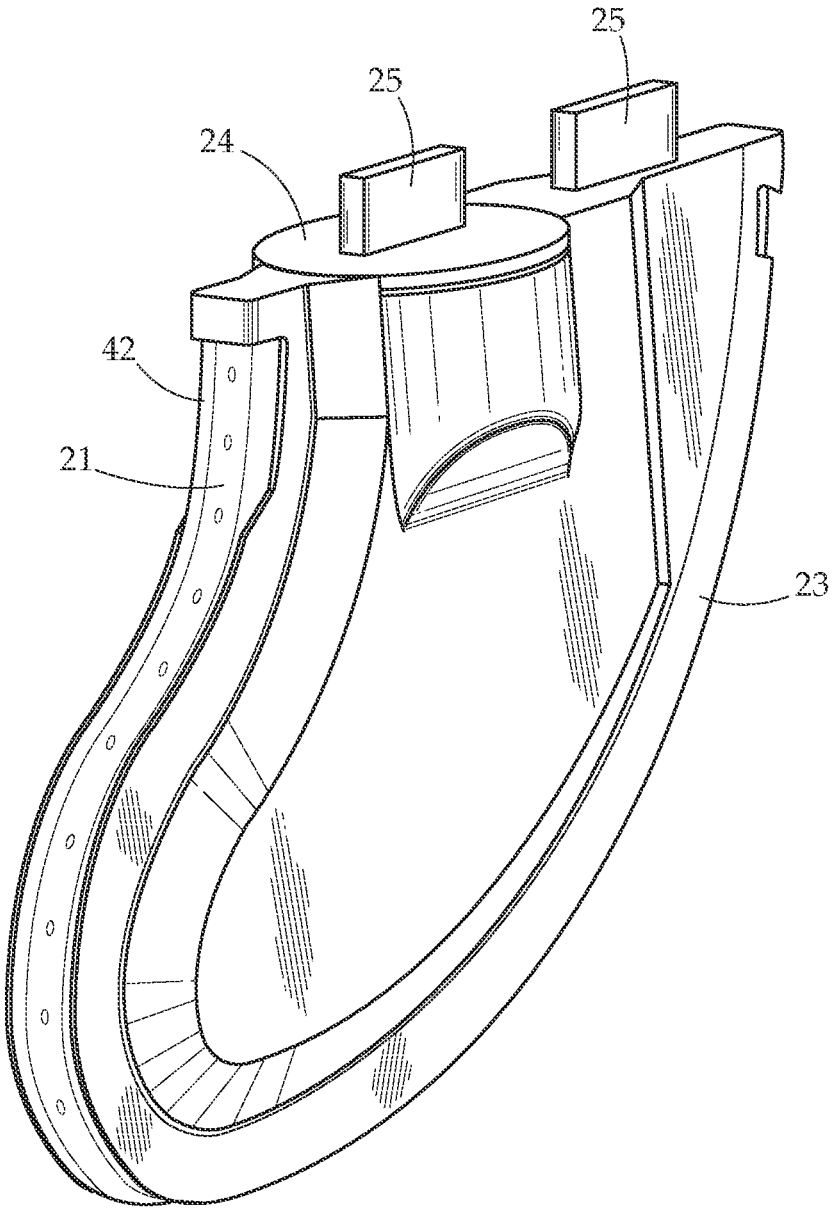
FIG. 4: Provides a perspective view of another embodiment of the present invention.

FIG. 3 shows another embodiment of the fin having a removably attachable component portion, also referred to herein as an accessory, insert, and insert accessory. In this view, the fin 33 defines a central aperture portion 32 in which an insert 31 may fit. This insert, in varying embodiments, may comprise any of: additional lighting in addition to perimeter lighting, a camera, the battery or other power source, a controller or microchip, and the like. In some embodiments, insert 31 is a waterproof container that is generally clear and provides housing for battery 34 and additional LED light source 35. LED strip 36 is installed around the perimeter in groove 37 of the fin body 33. In some embodiments, a camera (not shown) may be positioned on or within the insert 31. This camera may also be placed elsewhere on the fin without straying from the present invention. In embodiments having electronic components within the insert 31, a connector may be positioned on the insert 31 to mate with a connector of the fin body 33. ca FIG. 4 provides a perspective view of another embodiment of the present invention. In this view, the top connecting area of the illuminating fin 23 can be seen. Two connectors 25 extend from the fin 23. One of the connectors 25 is at a front of the fin, and another of the connectors 25 is part of the twist lock cover 24 which seals an interior component section of the fin 23. In other embodiments, the connector 25 need not be on the twist lock cover 24 and may be positioned anywhere on the fin 23 to connect to connection structures of the water sports board. Also, the twist lock cover 24 may be substituted with any other closure structure that may seal components of the fin 23. While the two connector system is shown in this figure, it should be understood that the fin may be attached to a water sports board in any manner, without straying from the scope of the present invention. This view further shows the lighting strip 21 about the perimeter of the fin 23. A waterproof covering layer 42 covers the lighting strip 21 to prevent entry of water. In some embodiments, a camera holder or attachment area may be positioned on the fin 23 to allow connection of a camera to the fin 23, such as a waterproof camera.

Figure 5:
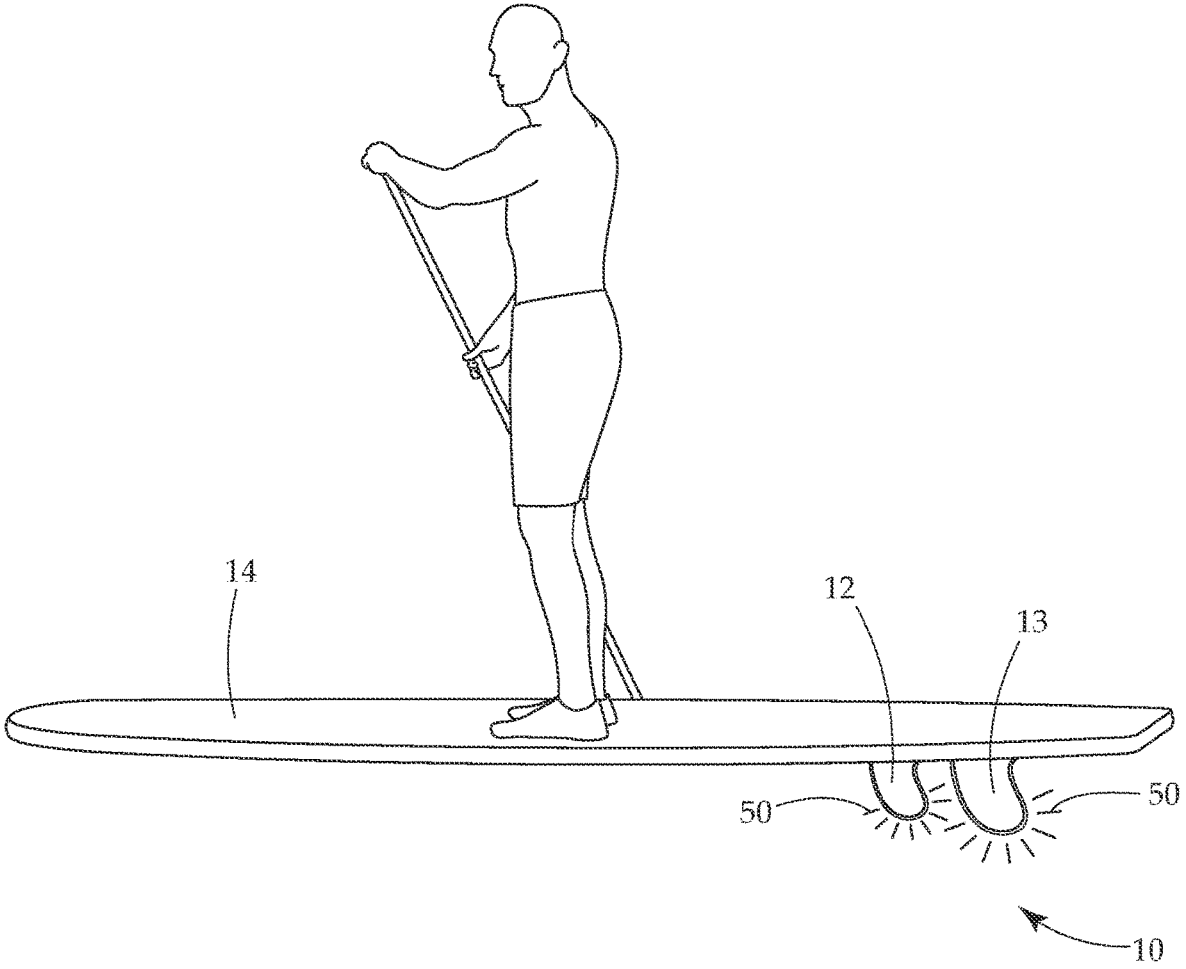
FIG. 5: Provides a view of an embodiment of the present invention installed on a water sports board in use.

FIG. 5 provides a view of the illuminating fins of the present invention in use on a water sports board. A user is standing on a paddle board 14 in this view. The board 14 comprises a front fin 50 and a rear fin 13, which are both illuminated, as indicated by light beams 50. The fins 12, 13, are mounted to a rear bottom surface 10 of the board. In an embodiment of use, a user may activate the illuminating fins to provide light underneath the water sports board. As noted above, activation may be achieved by remote control, or control on the fin or board, depending on actuation embodiments. This activation may be done before or after mounting the board by the user. Once activated, a user may use the board as normal. For example, in a paddle board embodiment, the user may paddle about, or may perform yoga, stretches, resting, and the like on the board. In a surf board embodiment, the user may ride waves, and the like.

Figure 6:
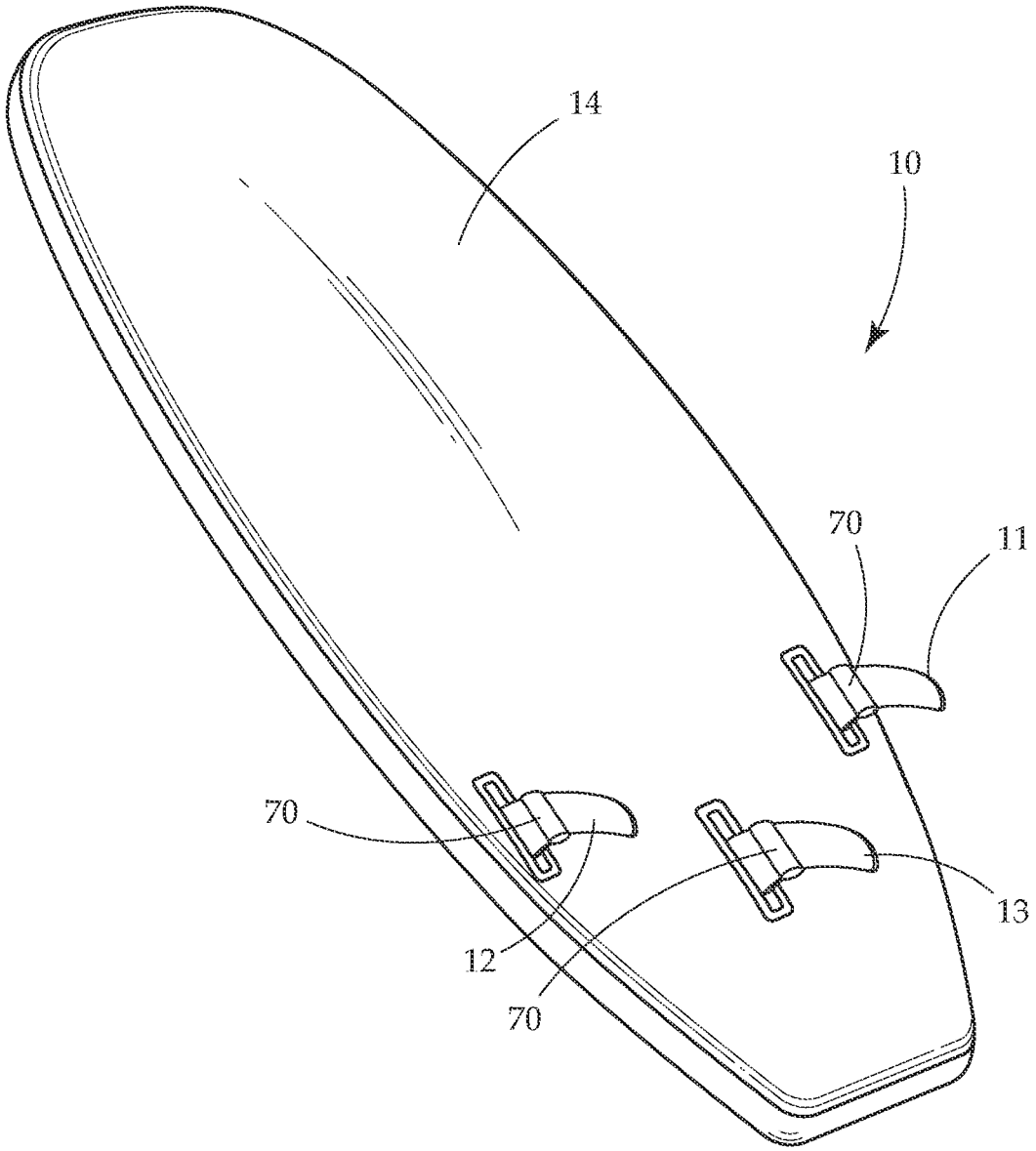
FIG. 6 provides a perspective view of another embodiment of the present invention installed on a water sports board.

FIG. 6 shows a traditional watersports board 14 fin system generally located at rear bottom surface 10. The fin system is comprised of a main center fin 13 and two optional fins 11 and 12 attached to watersports board 14. The fin 11, 12, 13 may have an insert accessory attached to it, allowing the fin to be equipped with an accessory to modify functionality of the fin. A fin insert accessory may be integrated with the center fin 13 and/or fins 11 and 12. Each of the center fin 13 and optional fins 11, 12 have an accessory connector section 70, in this view defined as an open cavity extending lengthwise from front to back of the fin 11, 12, 13. An insert accessory (which may be the same or different) may fit into each of the accessory connector sections 70. Generally, the insert accessory may connect to the fin in any manner, including, but no limited to physical engagement with a portion of the fin, frictional fitting, twist lock fitting, threaded connection to the fin, threaded connection to a nut such as a cone-shaped nut, passing a pin through a slot in the accessory to hold it in place relative to the fin, adhesive, magnetic connection, frictional fit, and the like. The insert accessory of this and similar embodiments generally may be any structure partially or fully fittable into the cavity. So in this embodiment shown, the insert accessory may have any structure comprising a generally cylindrical protruding connector section 70. The insert accessory may be a blank of material and/or may have an extending portion away from the connector section 70 which may add functionality via shape or components connected or within it.

Figure 7:
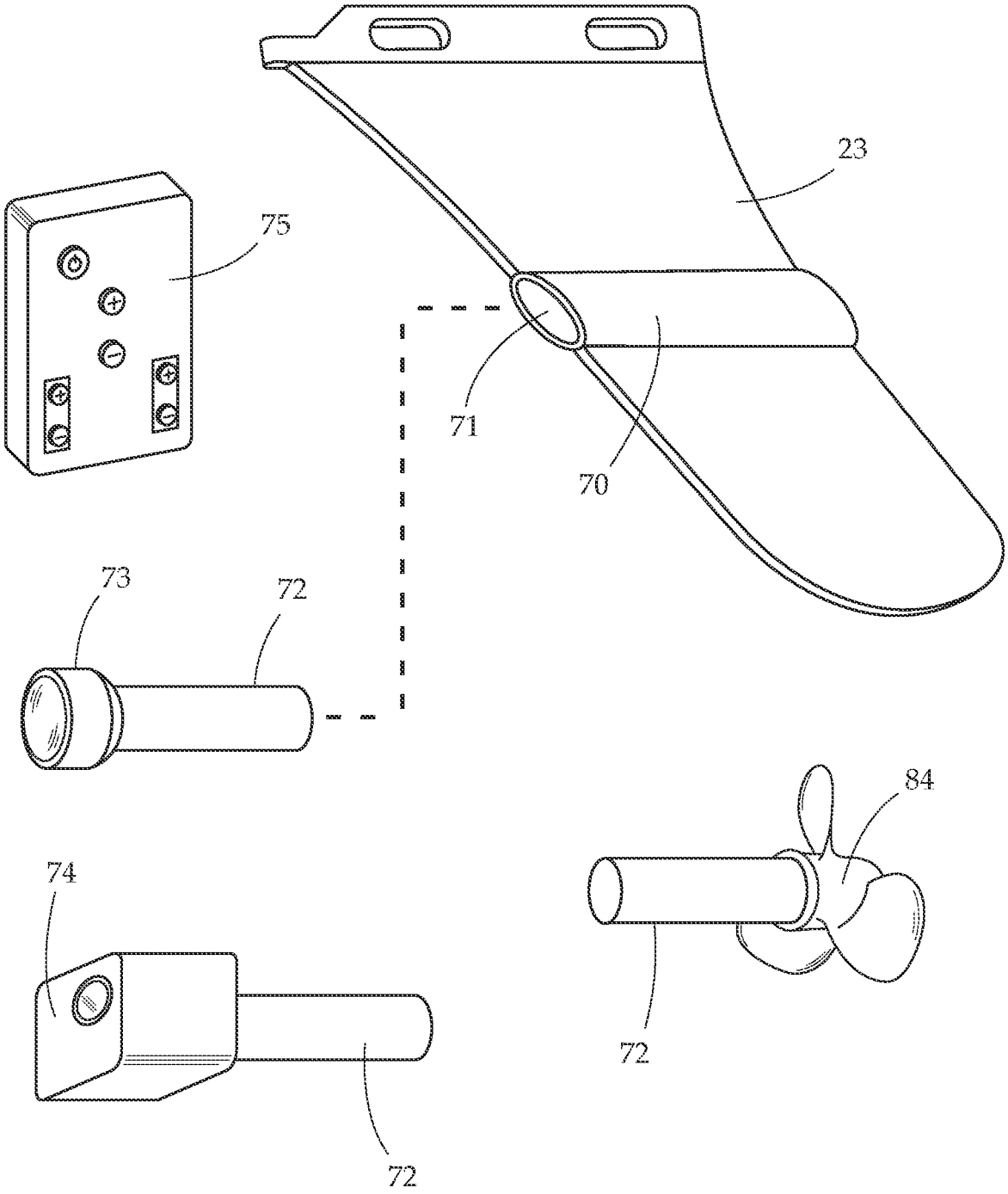
FIG. 7 provides a perspective view an embodiment of the fin along with a plurality of different inserts which can be attached to the fin.

FIG. 7 shows the fin 20 capable of receiving various accessories with an accessory connector section 70 formed as a universal hollow bore cavity 71, also referred to as an aperture. This cavity 71 may extend partially into the fin 20 or, as shown in this embodiment, fully through the fin 20 from one lengthwise end to the other. Connector sections 70 extending widthwise or in any other directions relative to the fin are also contemplated. In many embodiments disclosed, the connector section 70 is shown as a cavity or opening into which the insert accessory may fit. In other embodiments, the connector section 70 may be, among other options, a protrusion which may engage with an insert accessory, for example as a bracket, a prong, a snap fit connector, and the like.

Insert accessories may be removably connected to the connector section. Examples of connection insert accessories connectable to the fin at the connector section are shown at 73, 74 and 84. For example, a light insert 73 can installed into hollow cavity 71 on the fin connector section 70. The light insert 73 has a connection portion 72 which is sized and shaped to fit into the cavity 71, and a light source portion which, in this view, is wider and contains a light and electricity source such as a battery. The connection portion 72 is shown in this view as a frictionally fitting shaft which snugly fits into the connector section hollow cavity 71. In other embodiments, the connection portion 72 may be operated in a twist lock structure having a protrusion or recession or other keyed structure which engages with a matching protrusion/recession/keyed structure within the hollow cavity 71. A motor insert 84 can be connected in the same fashion as light assembly 73. The motor insert 84 has a connection portion 72 which, as with the light insert 73, fits into the cavity 71. The motor insert accessory 84 also has a propeller section which comprises a small motor and energy source such as a battery. A propeller is connected to the motor (not shown) and spins upon an actuation of the motor, which can cause forward or rearward propulsion against the fin, and any board the fin is attached to. A camera insert 74 having a camera, and similar structure to other insert accessories of this embodiment, including a connection portion 72 may also be installed in same hollow cavity 71.

In some configurations of the fin, a combination of insert accessories may exist and share the common cavity. For example a light may be connected in the front of the cavity 71, while a motor insert 84 fits in the rear part of it, such that a light protrudes from the front of the fin and a propeller protrudes from the rear. Of course, these may be reversed and modified without straying from the scope of this invention.

The insert accessories may be accessory devices beyond the scope of this description, without straying away from the main purpose of an accesorizable fin system. In other embodiments, the camera insert can be located pointing forward and propulsion device insert pointing rearwards. Indeed, alternative inserts of various function may be used without straying from the scope of this invention.

Figure 8:
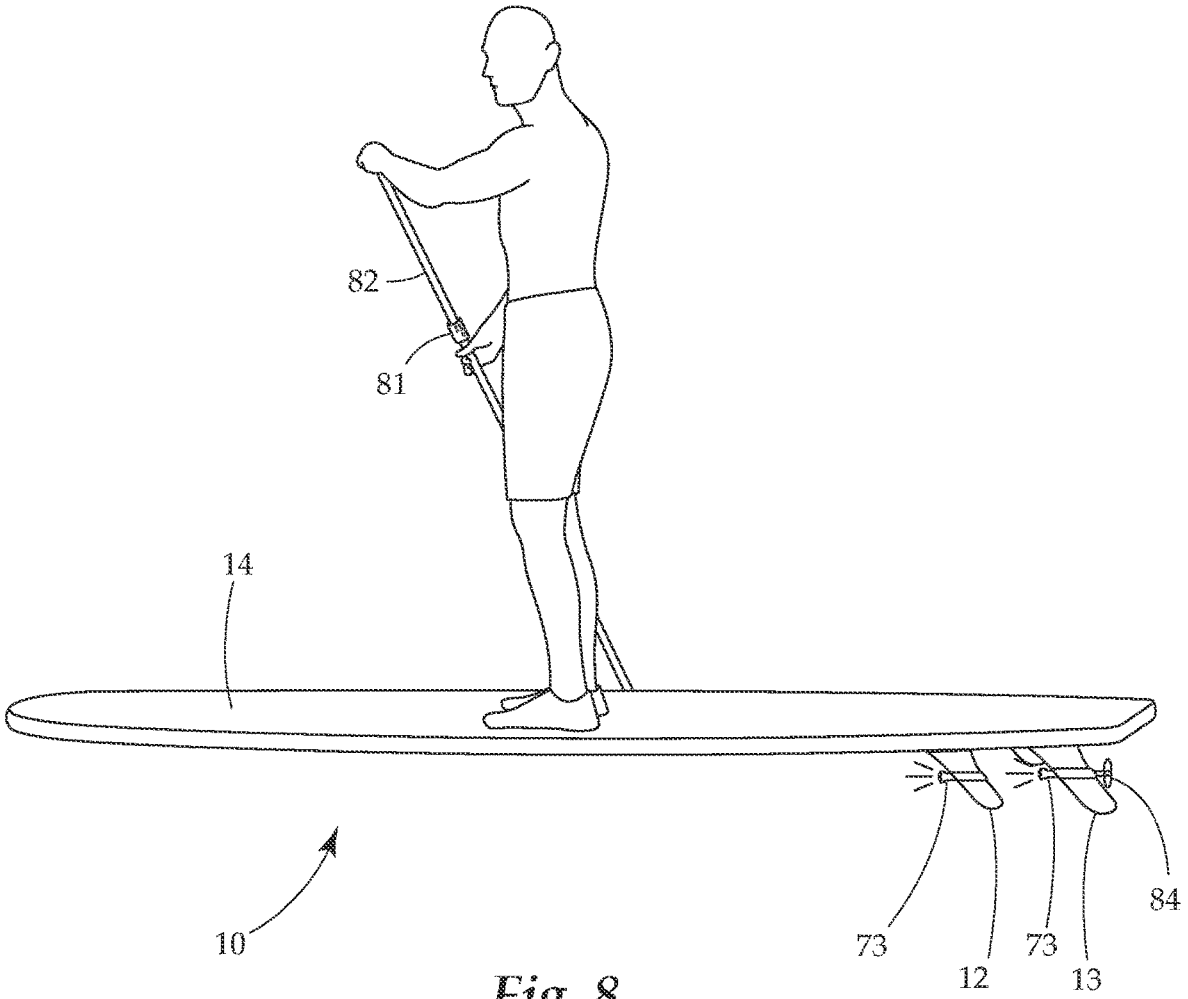
FIG. 8 provides a perspective view of another embodiment of the present invention installed on a water sports board.

Remote control 75 may be used to communicate with accessory insert to control activation and other functional operations on the insert accessory. Furthermore remote control 75 may be integrated with the user paddle 82 as shown in FIG. 8. It should be understood the universal method for insert attachment will yield a variety of combinations. In some cases, parts may be connected or integrated to the fin itself, including but not limited to a receiver, microcontroller, battery, and the like.

The shape of the cavity 71 of the connector 70 may vary, and may also only extend through part of the fin 11. For example, cavity 71 may extend partly into the fin from the front, or from the rear, or may extend from front to rear, without straying from the scope of this disclosure. Another insert accessory, not shown, may include a blank, which is simply an insert to fit into the cavity to allow the fin to act only as a fin, and to fill in the connector 70 so as to streamline the profile of the fin, limiting drag. Still another insert accessory example may include a blank having a built in GPS tracker. In other embodiments, the GPS tracker may be built into any other insert accessory, such as a light insert accessory, propeller insert accessory, camera insert accessory, and the like. The GPS tracker may allow for recording and tracking of motions when using the accessory, and may also allow location of it in the event it gets lost. Further still, in some embodiments, the accessory insert and/or fin may comprise a shark repellent. Examples of shark repellents include but are not limited to magnetic shark repellents, electropositive repellents, electrical repellents, and chemical repellents.

FIG. 8 provides a view of the accessorize-able fins of the present invention in use on a water sports board. A user is standing on a paddle board 14 in this view. The board 14 comprises a front fin 12 and a rear fin 13, which are accessorized with one light insert 73 on the front of the front fin 12 and both a light insert 73 and propeller motor insert 84, on the front and rear of the rear fin 13 respectively. The fins 12, 13, are mounted to a rear bottom surface 10 of the board. In an embodiment of use, a user may activate the illuminating fins to provide light underneath the water sports board whilst the propulsion device, once activated, provides a forward or reverse thrust. As noted above, user has the ability to choose which insert accessory is placed in which fin allowing customization.

Activation may be achieved by remote control, or control on the fin or board, depending on actuation embodiments. This activation may be done before or after mounting the board by the user. Once activated, a user may use the board as normal. For example, in a paddle board embodiment, the user may paddle about and seek to record images of the marine life below, while using the propulsion device to navigate against a current. In a surf board embodiment, the user may ride waves while seeking to photograph new perspectives for the world to see, and the like. In yet another paddle board embodiment, the user may use the micro controller device to take part in a game which is played on the paddle board, which said accessory device is in communication with the microcontroller 81 and can speed up or slow down the propeller and in turn the board in strategic or non strategic fashion. In this view, the remote control is integrated into the paddle 82 and communicates wirelessly with the one or more inserts, such as the light and propeller motor inserts 73, 84 shown in this embodiment. In one embodiment, the remote control may be operable to cause a microcontroller in the fin or insert accessory change an electrical signal. This change in electrical signal may in turn adjust a brightness or color of a light, may turn a light or other electronic component on or off, may cause a pulsing or flashing of a light, may cause a camera to record a video or still photo, may change a speed or direction of a motor, and may control other inputs and outputs of the insert accessory, for example.

Figure 9:
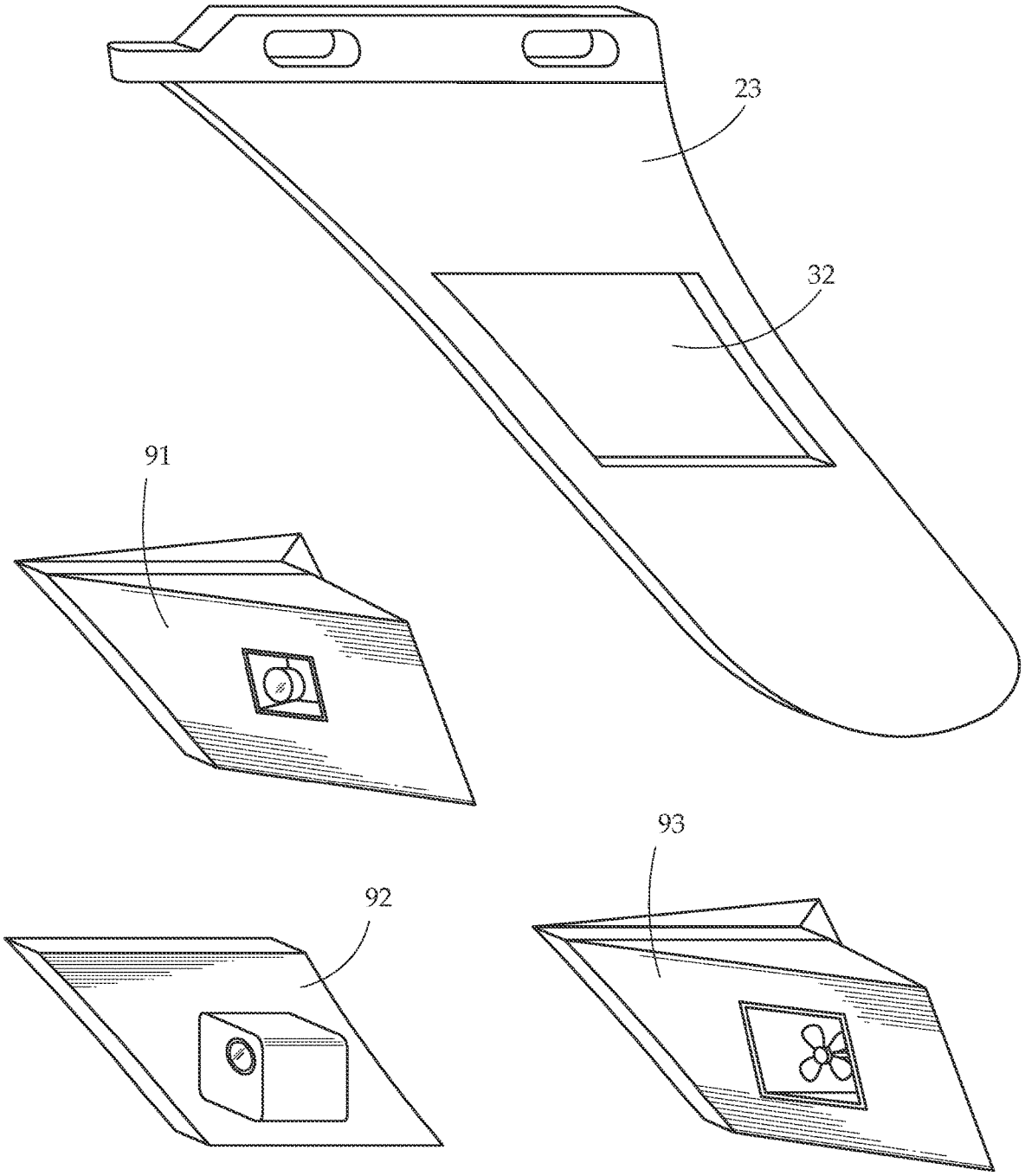
FIG. 9 provides a perspective view an embodiment of the fin along with a plurality of different inserts which can be attached to the fin.

FIG. 9 shows another embodiment of the fins contemplated herein having attachable accessories. In this view, the fin body 23 defines an accessory connector section defined as a transverse aperture or cavity 32 into which an insert accessory may fit. As noted above, the insert accessory of this embodiment may be any structure capable of fitting into the cavity, and the insert may have varying functional features, including, but not limited to those disclosed herein. Exemplary insert accessories may comprise any of: additional lighting in addition to or instead of perimeter lighting, a camera, the battery or other power source, a controller or microchip, propulsion device which may be used as an accelerating or braking device, shark repellent (such as those noted above), and the like. Examples of the accessory inserts connectable to the cavity 32 are also shown. For example, a light insert 91 has a body formed with an outwardly tapering body having an arrowhead shape. A light source is positioned on the outside of one or both angled front faces. The concave rear of the light insert 91, in this embodiment, allows it to be inserted into the cavity 32 at an angle, and then friction fit, snap fit, or the like, into place between the front and rear edges of the insert 91. A similarly structured camera insert 92 is shown, having a similar structure to the light insert 91, with a camera connected thereto and positioned to view and record the surroundings of the insert 92. This camera may also be placed elsewhere on the fin without straying from the present invention. Similarly, propeller motor insert 93 is similarly structured to the camera and light inserts 92, 91 to allow for a similar connection to the fin body 23 via cavity 32. The propeller insert 93 in this view comprises two impellers, one on each side of the propeller insert accessory 93, and each in a cavity extending from front to rear. The impeller is operable by a motor within the insert 93 and powered by a power source such as a battery. Similarly, light and camera inserts, and any other inserts having electronic components, may also be powered by a power source, such as a battery. In many embodiments, a microcontroller and transceiver are mounted within the insert to allow remote control of the components. Typically connection of the accessory to the fin is shown as a male-female connection with the connector formed as a cavity, and/or as a frictional or snap fit into a spacing defined by the fin, but of course other structures are contemplated herein without straying from the scope of this invention. It should be understood that the fin may be attached to a water sports board in any manner, without straying from the scope of the present invention. This view further shows the variety of geometries which may be possible to generate a variety of inserts to work with one common fin.

While several variations of the present disclosure have been illustrated by way of example in preferred or particular embodiments, it is apparent that further embodiments could be developed within the spirit and scope of the present disclosure, or the inventive concept thereof. However, it is to be expressly understood that such modifications and adaptations are within the spirit and scope of the present disclosure, and are inclusive, but not limited to the following appended claims as set forth.

What is claimed is:

1. A fin for a water sports board comprising:

a body defining a connector section, the fin body connectable to the water sports board;

an insert accessory removably connected to the connector section;

wherein the insert accessory comprises a connection portion having an elongate shape with a cross section being sized and shaped to fit within the connector section of the body, the connector section of the body being an aperture;

wherein the aperture is formed as a cavity extending between lengthwise ends of the body, the cavity being open at a front and rear of the body;

the elongate connection portion fitted within the aperture and at least partially filling a cross section of the connector section; and the insert accessory further comprising an accessory portion at a distal end, the accessory portion positioned away from at least one of the lengthwise ends of the body.

2. The fin of claim 1 wherein the accessory portion of the insert accessory comprises a light.

3. The fin of claim 2 wherein the light of the accessory portion is configured to direct light outwardly away from the fin and under the water sports board when connected to the water sports board.

4. The fin of claim 1 wherein the accessory portion of the insert accessory comprises a camera.

5. The fin of claim 1 wherein the accessory portion of the insert accessory comprises a motor and a propeller.

6. The fin of claim 1 further comprising a second insert accessory removably connected to the connector section on an opposite side of the connector section from the insert accessory.

7. The fin of claim 1 wherein the insert accessory is friction fit to the body connector section.

8. The fin of claim 1 further comprising a power source within the insert accessory.

9. A water sports board comprising the fin of claim 1.

10. A water sports board further comprising a plurality of fins of claim 1, each of the plurality of fins attached to a bottom of the board.

11. The water sports board of claim 10 wherein a first of the plurality of fins comprises an insert accessory comprising a light, and a second of the plurality of fins comprises an insert accessory comprising a propeller and motor.

12. The fin of claim 1 wherein the insert accessory comprises a receiver and microcontroller in wireless communication with a remote controller.

13. The fin of claim 12 wherein the remote controller is integrated into a paddle.

14. A fin for a water sports board comprising:

a body defining a connector section, the fin body connectable to the water sports board;

an insert accessory removably connected to the connector section;

wherein the connector section is defined as an aperture passing at least partially through the fin body and wherein the insert accessory comprises a connection portion having a shape which fits within the aperture; and wherein the aperture is formed as a cavity extending between widthwise ends of the body, the cavity being open at a left and right side of the body.

15. A fin for a water sports board comprising:

a body defining a connector section, the fin body connectable to the water sports board;

an insert accessory connected to the connector section; and wherein the insert accessory comprises a receiver and microcontroller in wireless communication with a remote controller.

16. The fin of claim 15 wherein the remote controller is integrated into a paddle.

17. The fin of claim 15 wherein the insert accessory is removably connected to the connector section.

18. The fin of claim 15 wherein the insert accessory comprises a light.

19. The fin of claim 15 wherein the insert accessory comprises a camera.

20. The fin of claim 15 wherein the insert accessory comprises a battery.

21. The fin of claim 15 wherein the insert accessory is friction fit to the body connector section.

22. The fin of claim 15 wherein the remote controller is operable to activate the insert accessory.

23. The fin of claim 15 wherein the microcontroller comprises a switch.

* * * * *